US010569985B2

(12) United States Patent
Tomioka et al.

(10) Patent No.: US 10,569,985 B2
(45) Date of Patent: Feb. 25, 2020

(54) IMAGE FORMING APPARATUS AND RECORDING MATERIAL TRANSPORT DEVICE

(71) Applicant: FUJI XEROX CO., LTD., Tokyo (JP)

(72) Inventors: Hiromitsu Tomioka, Kanagawa (JP); Teruki Naganuma, Kanagawa (JP); Keita Yano, Kanagawa (JP); Yuki Sekura, Kanagawa (JP); Kohei Takahashi, Kanagawa (JP); Junichi Asaoka, Kanagawa (JP); Yuichiro Shimura, Kanagawa (JP); Mizuki Arai, Kanagawa (JP); Akira Iwasaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/115,596

(22) Filed: Aug. 29, 2018

(65) Prior Publication Data

US 2019/0292000 A1 Sep. 26, 2019

(30) Foreign Application Priority Data

Mar. 20, 2018 (JP) ..... 2018-053468

(51) Int. Cl.

| | |
|---|---|
| ***B65H 29/58*** | (2006.01) |
| ***B65H 29/12*** | (2006.01) |
| ***G03G 15/00*** | (2006.01) |

(52) U.S. Cl.

CPC ..... *B65H 29/58* (2013.01); *B65H 29/125* (2013.01); *G03G 15/6529* (2013.01)

(58) Field of Classification Search

CPC ..... B65H 29/58; B65H 29/125; B65H 85/00; B65H 2402/10; B65H 2402/441;

(Continued)

(56) References Cited

U.S. PATENT DOCUMENTS

| | | | |
|---|---|---|---|
| 8,213,854 B2 | 7/2012 | Iida et al. | |
| 10,016,992 B2 * | 7/2018 | Kotaka | H04N 1/00519 |

(Continued)

FOREIGN PATENT DOCUMENTS

| | | |
|---|---|---|
| JP | 2010-70368 | 4/2010 |
| JP | 5338894 | 11/2013 |
| JP | 5435098 | 3/2014 |

*Primary Examiner* — David H Bollinger
(74) *Attorney, Agent, or Firm* — JCIPRNET

(57) ABSTRACT

An image forming apparatus includes: an apparatus body including an image former that forms an image on a recording material; a covering part that is provided in the apparatus body and leaves an inside of the apparatus body open by being opened in an opening direction with respect to the apparatus body; a reversing unit that is housed by the apparatus body and discharges part of the recording material on which the image is formed by the image former externally of the apparatus body, and reverses a transport direction of the recording material; and a guiding unit that is provided adjacent to a downstream side of the covering part in the opening direction, guides the recording material discharged through the apparatus body by the reversing unit, and when the covering part is opened with respect to the apparatus body, the guiding unit moves relatively with respect to the covering part in an opposite direction of the opening direction.

16 Claims, 8 Drawing Sheets

(58) Field of Classification Search
CPC ..... G03G 15/6529; G03G 15/6579; G03G 15/234; G03G 2215/0043; G03G 2215/00438; G03G 2215/00586
See application file for complete search history.

(56) References Cited

U.S. PATENT DOCUMENTS

2015/0274477 A1* 10/2015 Kodama ..... B65H 5/36 271/3.19
2015/0309462 A1* 10/2015 Sunohara ..... G03G 15/6529 271/264
2015/0346669 A1* 12/2015 Choi ..... G03G 15/234 399/388
2016/0124370 A1* 5/2016 Miwa ..... G03G 15/6552 399/405
2016/0144636 A1* 5/2016 Kotaka ..... B41J 2/16508 347/104

* cited by examiner

IMAGE FORMING APPARATUS AND RECORDING MATERIAL TRANSPORT DEVICE

CROSS-REFERENCE TO RELATED APPLICATIONS

This application is based on and claims priority under 35 USC 119 from Japanese Patent Application No. 2018-053468 filed on Mar. 20, 2018.

BACKGROUND

Technical Field

The present invention relates to an image forming apparatus and a recording material transport device.

SUMMARY

According to an aspect of the invention, there is provided an image forming apparatus including: an apparatus body including an image former that forms an image on a recording material; an opening unit that leaves an inside of the apparatus body open by being opened in a predetermined opening direction with respect to the apparatus body; a reversing unit that discharges part of the recording material on which the image is formed by the image former externally of the apparatus body, and reverses a transport direction of the recording material; and a guiding unit that is provided adjacent to a downstream side of the opening unit in the opening direction, guides the recording material discharged through the apparatus body by the reversing unit, and when the opening unit is opened with respect to the apparatus body, moves in an opposite direction to the opening direction relatively with respect to the opening unit.

BRIEF DESCRIPTION OF THE DRAWINGS

Exemplary embodiment of the present invention will be described in detail based on the following figures, wherein.

DETAILED DESCRIPTION

<Description of Image Forming System>

Figure 1:
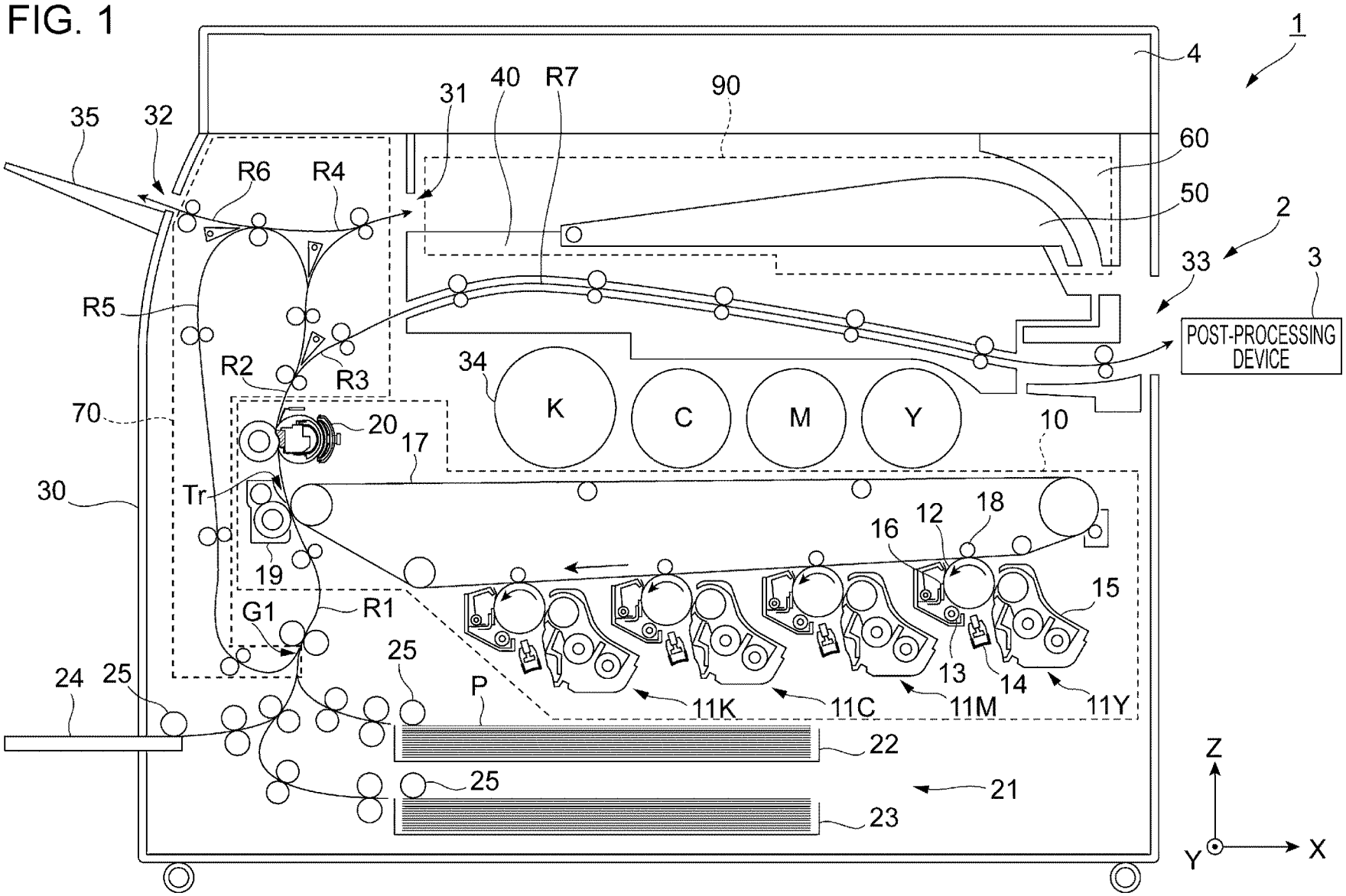
FIG. 1 is an overall configuration view of an image forming system according to an exemplary embodiment.

Hereinafter, an exemplary embodiment of the invention will be described in detail with reference to the accompanying drawings. FIG. 1 is an overall configuration view of an image forming system 1 according to the exemplary embodiment as viewed from the front side, which receives an instruction and an operation from a user, of the image forming system 1. The image forming system 1 illustrated in FIG. 1 includes, for instance, an image forming apparatus 2 that forms an image on paper P which is an example of a recording material using an electrophotographic system; a post-processing apparatus 3 including a paper loader that collects and bundles paper P on which an image is formed, and a binding processor that binds ends of paper P; and an image reading apparatus 4 that reads an image formed on a document. In the image forming system 1 in the exemplary embodiment, the image reading apparatus 4 as an example of an image reader is disposed above the image forming apparatus 2 in the direction of gravitational force. Also, the post-processing apparatus 3 is horizontally disposed adjacent to the image forming apparatus 2. In the description below, in the image forming system 1, Z-direction is defined as the direction from a lower position toward an upper position, Y-direction is defined as the direction from the rear side toward the front side, and X-direction is defined as the direction that is perpendicular to Z-direction and Y-direction and is from the left side toward the right side as viewed from the front side.

The image forming apparatus 2 is so-called a tandem type color printer, and includes an image former 10 that performs image forming based on image data, and a paper feeder 21 that supplies paper P to the image former 10. The image forming apparatus 2 includes a toner cartridge 34 that has colors of yellow (Y), magenta (M), cyan (C), and black (K), and supplies toner of each color to the image former 10. In addition, the image forming apparatus 2 includes a paper transporter 70, as an example of a transporter, that transports paper P on which an image is formed by the image forming apparatus 2; and a paper guiding unit 90, as an example of a recording material transport device, that guides paper P whose transport direction is reversed by the paper transporter 70. In addition, the image forming apparatus 2 includes a paper discharge section 35 that discharges paper P on which an image is formed and which is transported by the paper transporter 70.

In addition, the image forming apparatus 2 includes a housing 30, as an example of an apparatus body, that internally houses and holds the image former 10, the paper feeder 21, and the paper transporter 70. In the housing 30, a first discharge outlet 31, as an example of a discharge outlet for reversal, that discharges paper P to the paper guiding unit 90, a second discharge outlet 32 through which paper P is discharged to the paper discharge section 35, and a third discharge outlet 33 through which paper P is discharged to the post-processing apparatus 3 are formed.

The image former 10 includes four image forming units 11Y, 11M, 11C, and 11K (hereinafter collectively referred to as an image forming unit 11) for yellow (Y), magenta (M), cyan (C), and black (K), which are disposed side by side at regular intervals. Each image forming unit 11 includes a photoconductor drum 12 that forms an electrostatic latent image and carries a toner image, a charger 13 that charges the surface of the photoconductor drum 12, and an exposure 14 that exposes the photoconductor drum 12 charged by the charger 13, based on image data. In addition, each image forming unit 11 includes a developing unit 15 that develops an electrostatic latent image formed on the photoconductor drum 12, and a cleaner 16 that cleans the surface of the photoconductor drum 12 after transfer.

In addition, the image former 10 includes an intermediate transfer belt 17 on which each color toner image formed on the photoconductor drum 12 of each image forming unit 11 is multiply transferred, a first transfer roller 18 that sequentially (first transfer) transfers each color toner image formed by each image forming unit 11 to the intermediate transfer belt 17, a second transfer roller 19 that collectively transfers (second transfer) superimposed toner images, which have been transferred onto the intermediate transfer belt 17, to paper P at second transfer position Tr, and a fuser 20 that fixes a secondarily transferred image onto paper P.

The paper feeder 21 includes a first paper feed tray 22 and a second paper feed tray 23 that each supply paper P to a first paper transport route R1. It is to be noted that the first paper feed tray 22 and the second paper feed tray 23 are configurated in the same manner. Also, the paper feeder 21 includes a manual feed tray 24 which is used when paper P is manually fed. In addition, the paper feeder 21 includes a delivery roller 25 which is provided on the downstream side in the transport direction on each of the first paper feed tray 22, the second paper feed tray 23, and the manual feed tray 24, and which takes and transports paper P to the second transfer position Tr of the image former 10 along a transport route from each tray. The transport routes extending from the first paper feed tray 22, the second paper feed tray 23, and the manual feed tray 24 are merged at an upstream end of the first paper transport route R1.

It is to be noted that the image forming apparatus 2 of the image forming system 1 in the exemplary embodiment is a so-called color printer that forms Y, M, C, and K color images on paper P. However, the image forming apparatus 2 is not limited to a color printer. The image forming apparatus 2 may be a so-called monochrome printer that forms, for instance, a monochrome image on paper P.

<Description of Paper Transporter>

Figure 2:
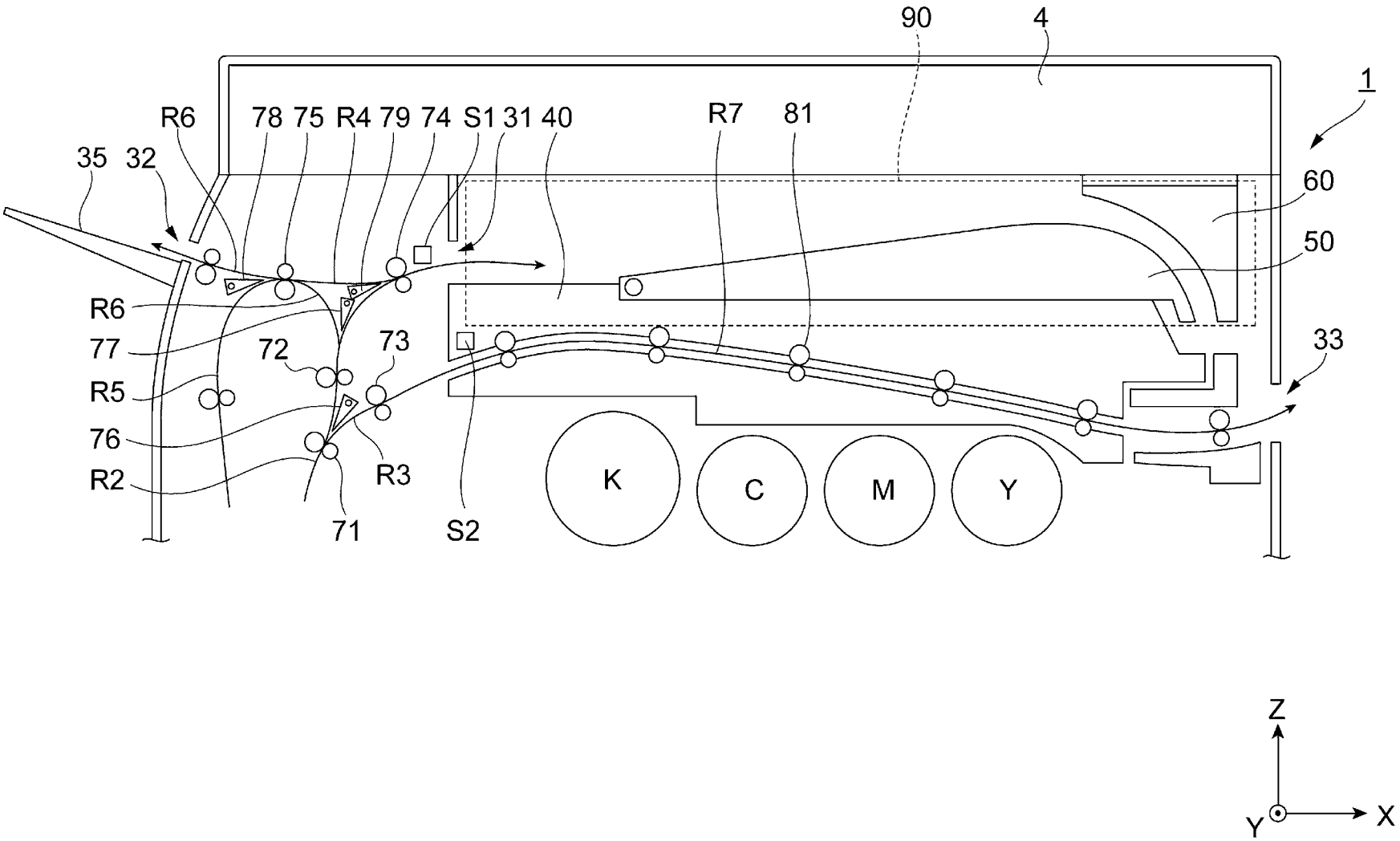
FIG. 2 is an enlarged view of a paper transporter and a paper guiding unit of the image forming system.

Subsequently, the paper transporter 70 that transports paper P with images formed will be described. FIG. 2 is an enlarged view of the paper transporter 70 and the paper guiding unit 90 of the image forming system 1. The paper transporter 70 includes a first transport roller 71 that transports paper P, on which an image is formed by the image former 10, to the downstream side in the transport direction; and a second transport roller 72 and a third transport roller 73 that each transport paper P transported by the first transport roller 71 to the further downstream side in the transport direction. In addition, the paper transporter 70 includes a reverse transport roller 74, as an example of a reversing unit, that reverses the transport direction of paper P transported by the second transport roller 72. In addition, the paper transporter 70 includes a branch roller 75 that transports paper P with the transport direction reversed by the reverse transport roller 74 to the paper discharge section 35 or the image former 10 again. Furthermore, the paper transporter 70 includes multiple fourth transport rollers 81 that transport the paper transported by the third transport roller 73 to the post-processing apparatus 3. Each of the fourth transport rollers 81 is configurated by driving rollers 81*a* (see FIG. 4 described later), as an example of a different transporter, that are rotationally driven by a driving unit (not illustrated); and driven rollers 81*b* (see FIG. 4 described later), as an example of a transporter, that are pressed by the driving rollers 81*a* and driven to be rotated by the driving rollers 81*a*.

In addition, the paper transporter 70 includes a second paper transport route R2 that is provided extending upward from the first paper transport route R1 of the image former 10; and a third paper transport route R3 that branches between the first transport roller 71 and the second transport roller 72 from the second paper transport route R2 to the right side in FIG. 2, and is used for transportation of paper P to the paper guiding unit 90. In addition, the paper transporter 70 includes a fourth paper transport route R4 that branches upward from the second paper transport route R2 on the downstream side the second transport roller 72 in the transport direction, provided to be bent to the right side in FIG. 2, and is used for transportation of paper P to the reverse transport roller 74; and a fifth paper transport route R5 that branches from the fourth paper transport route R4 to the left side in FIG. 2, provided extending downward, and is used for transportation of paper P again to a merging point.

Furthermore, the paper transporter 70 includes a sixth paper transport route R6 that branches to the left side in FIG. 2 from the fourth paper transport route R4 on the upstream side of the reverse transport roller 74 with respect to the fourth paper transport route R4, and is used for transportation of paper P to the paper discharge section 35. In addition, the paper transporter 70 includes a seventh paper transport route R7, as an example of a transport route or a transporter for reversal, that continues to the right side in FIG. 2 from the third paper transport route R3 on the downstream side of the third transport roller 73, and is used for transportation of paper P to the post-processing apparatus 3. It is to be noted that although the fifth paper transport route R5 and the sixth paper transport route R6 intersect at a point midway through the transport route, both routes are separately provided.

The paper transporter 70 includes a first switching gate 76 that is provided near the branch point of the second paper transport route R2 and the third paper transport route R3, and switches a transport destination of paper P between the second paper transport route R2 and the third paper transport route R3. Also, the paper transporter 70 includes a second switching gate 77 that is provided near the branch point of the fourth paper transport route R4 and the sixth paper transport route R6, and switches a transport destination of paper P between the fourth paper transport route R4 and the sixth paper transport route R6. In addition, the paper transporter 70 includes a third switching gate 78 that is provided near the branch point of the fifth paper transport route R5 and the sixth paper transport route R6, and switches a transport destination of paper P between the fifth paper transport route R5 and the sixth paper transport route R6.

Also, the paper transporter 70 includes a one-way transport gate 79 that is provided near the branch point of the fourth paper transport route R4 and the fifth paper transport route R5, and guides transportation of taper P to the downstream side of the fourth paper transport route R4. In addition, the paper transporter 70 includes a first detector S1 that detects paper P transported along the fourth paper transport route R4, and a second detector S2 that detects paper P transported along the seventh paper transport route R7.

<Description of State of Transport of Paper When Double-sided Printing is Performed>

Next, the state of transport of paper P in the paper transporter 70 when double-sided printing is performed on paper P in the image forming system 1 will be described with reference to FIGS. 1 and 2. First, when a double-sided printing instruction is received from a user, an image is formed by the image former 10 on one side of paper P fed from the paper feeder 21, then the paper P is transported along the second paper transport route R2 by the first transport roller 71. In this process, the first switching gate 76 projects on the third paper transport route R3. Paper P is guided by the first switching gate 76 to the downstream side of the second paper transport route R2, and is transported by the second transport roller 72.

The second switching gate 77 projects on the sixth paper transport route R6. Paper P is guided by the second switching gate 77 to the fourth paper transport route R4, passed through the one-way transport gate 79, and is further transported to the downstream side of the fourth paper transport route R4.

Subsequently, when paper P arrives at the reverse transport roller 74, the reverse transport roller 74 is rotated in the forward direction, and thus the downstream end (hereinafter referred to as one end of paper P) of paper P in the movement direction is discharged to the paper guiding unit 90 through the first discharge outlet 31. Although details will be described later, the one end of paper P discharged through the first discharge outlet 31 is guided to the paper guiding unit 90, thereby reducing interference of paper P with part of the housing 30 of the image forming apparatus 2 and the post-processing apparatus 3 (see FIG. 1).

Subsequently, the rotation direction of the reverse transport roller 74 is switched to the reverse direction based on a result of detection of paper P by the first detector S1 before the upstream end (hereinafter referred to as the other end of paper P) of paper P in the movement direction arrives at the reverse transport roller 74. Thus, the transport direction of paper P is reversed.

Subsequently, paper P is transported along the fifth paper transport route R5 by the guidance of the one-way transport gate 79. Also, the third switching gate 78 projects on the sixth paper transport route R6. Paper P is guided by the third switching gate 78 to the downstream side of the fifth paper transport route R5, and is transported to the downstream side of the fifth paper transport route R5 by the branch roller 75. Paper P arrives at the second transfer position Tr (see FIG. 1) of the image former 10 (see FIG. 1) again, an image is formed on the side of paper P on which no image has been formed, thus double-sided printing is performed.

After paper P with both sides printed is transported along the paper transporter 70, paper P is discharged to the paper discharge section 35 through the second discharge outlet 32 or discharged to the post-processing apparatus 3 through the third discharge outlet 33. Consequently, a series of processing for performing double-sided printing on paper P is completed.

<Description of Paper Guider>

Figure 3:
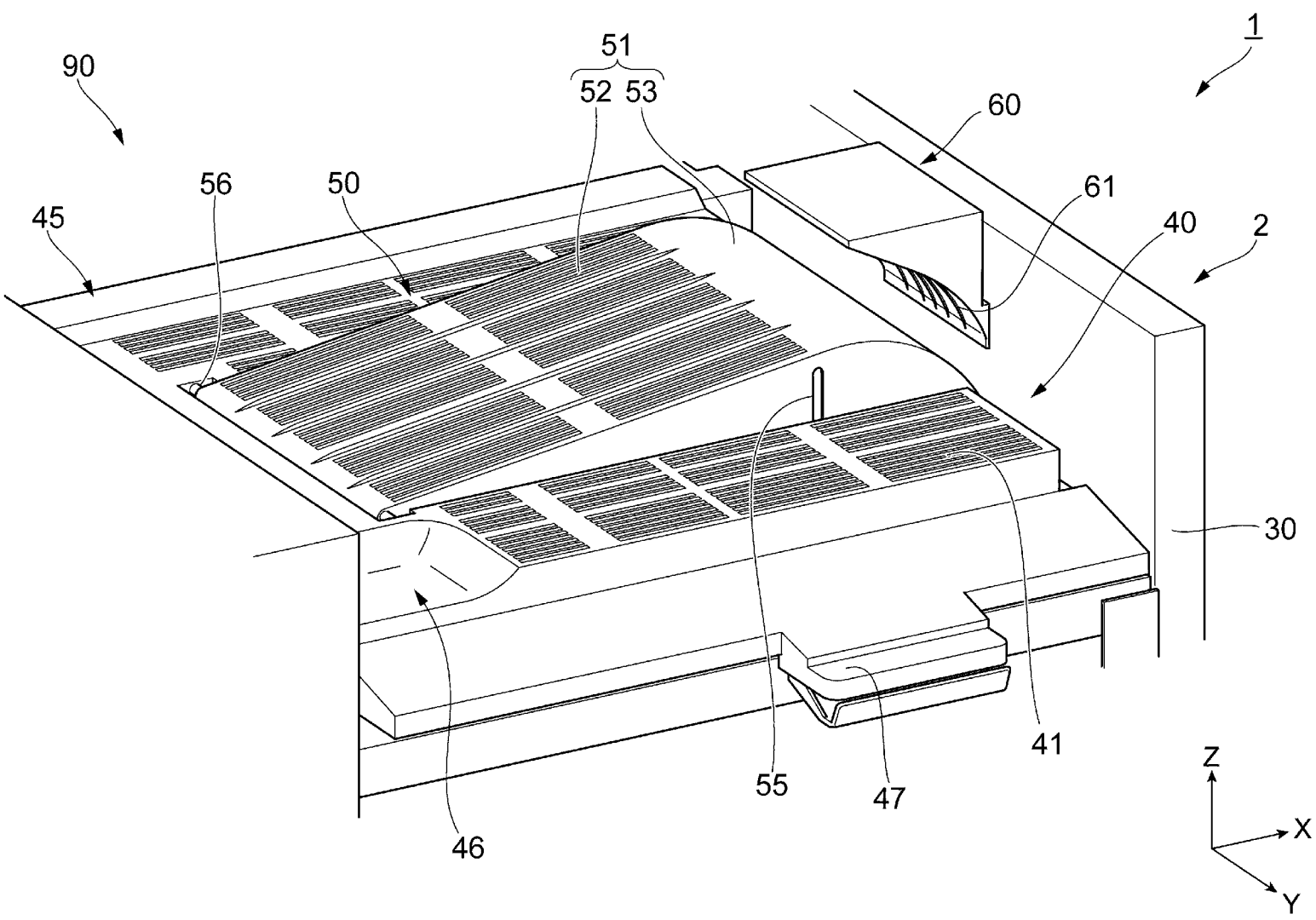
FIG. 3 is a perspective view of the paper guiding unit as viewed down from the front side of the image forming apparatus.
Figure 4:
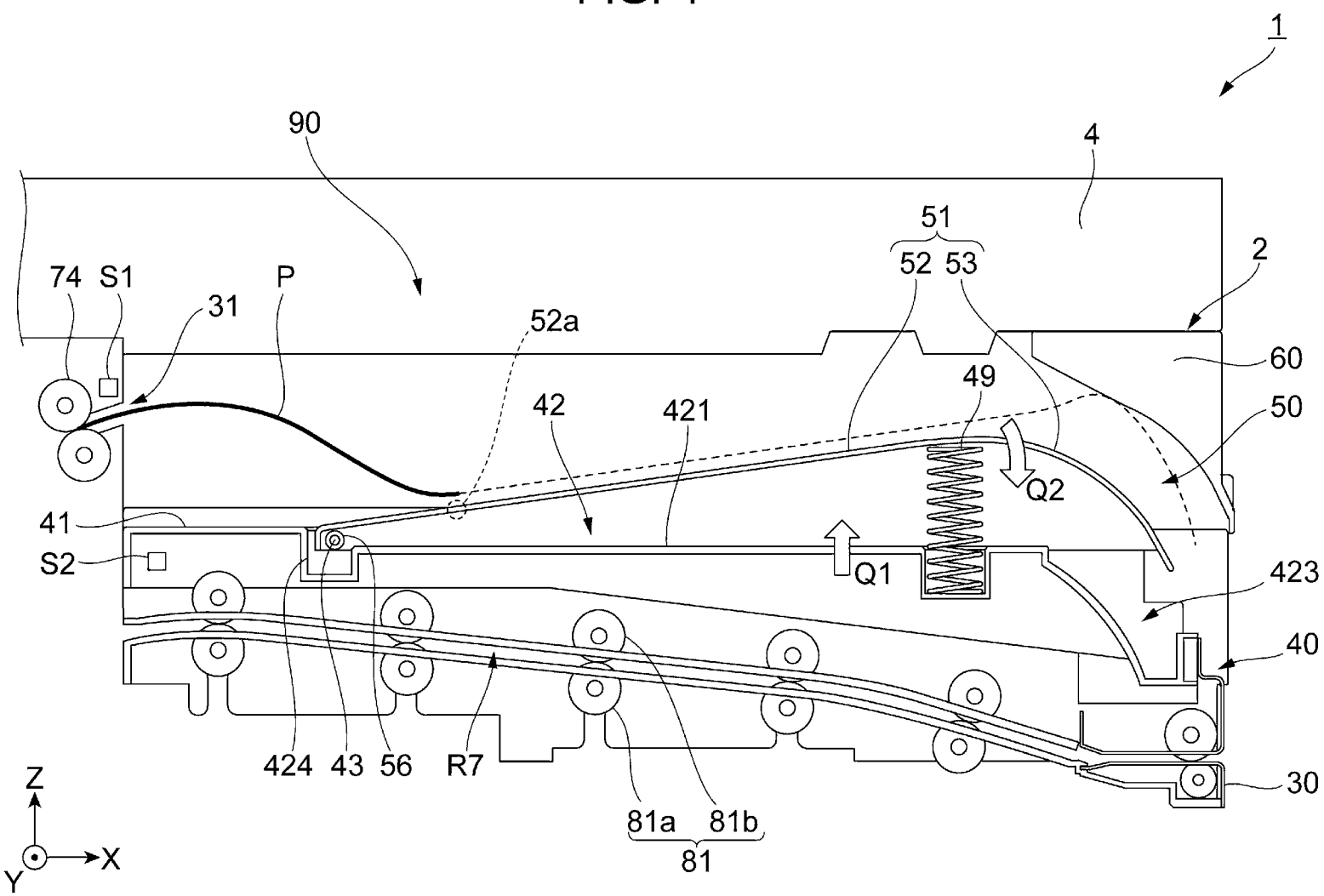
FIG. 4 is a sectional view of the paper guiding unit taken along ZX plane.

Next, the paper guiding unit 90 that guides transportation of paper P discharged by the reverse transport roller 74 will be described. FIG. 3 is a perspective view of the paper guiding unit 90 as viewed down from the front side of the image forming apparatus 2. FIG. 4 is a sectional view of the paper guiding unit 90 taken along ZX plane, and more specifically is a sectional view of the paper guiding unit 90 taken along ZX plane at a central portion of paper P in the width direction (Y direction). It is to be noted that the image reading apparatus 4 is not illustrated in FIG. 3.

The paper guiding unit 90 includes a covering part 40, as an example of an opening part, that is provided in the housing 30 in an openable manner. Although details will be described later, the covering part 40 is opened in a predetermined opening direction (Z direction in this example) with respect to the housing 30, and thus the seventh paper transport route R7 of the paper transporter 70 (see FIG. 1) housed inside the housing 30 is opened to the outside of the image forming apparatus 2. Also, the paper guiding unit 90 is provided on the downstream side of the covering part 40 in the opening direction in a movable manner with respect to the covering part 40 in association with an operation to open the covering part 40. The paper guiding unit 90 includes a movable guiding unit 50, as an example of a guiding unit, that guides the transport of paper P discharged through the first discharge outlet 31. Furthermore, the paper guiding unit 90 is fixed to the housing 30 so as to be opposed to the movable guiding unit 50, and includes the movable guiding unit 50 as well as a fixed guiding unit 60, as an example of a different guiding unit, that guides the transport of paper P discharged through the first discharge outlet 31.

<Description of Covering Part>

Figure 5:
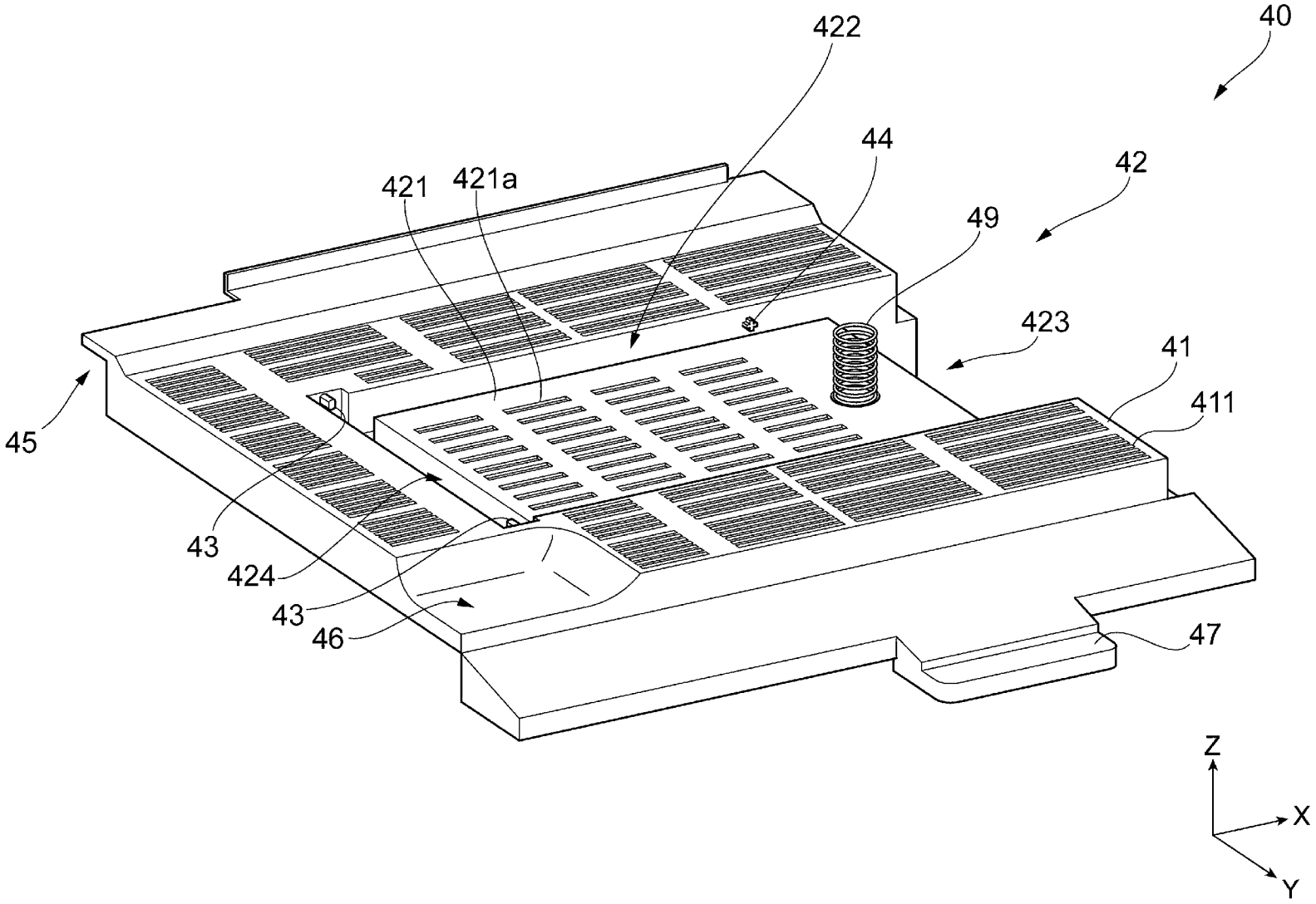
FIG. 5 is a perspective view illustrating a covering part according to an exemplary embodiment.

Next, the covering part 40 will be described in detail. FIG. 5 is a perspective view illustrating the covering part 40 according to the exemplary embodiment. FIG. 5 illustrates the covering part 40 in the state (that is, the state illustrated in FIG. 3) of closed with respect to the housing 30. The covering part 40 includes auxiliary guide surfaces 41 that guide paper P guided by the movable guiding unit 50 in an auxiliary manner, and a storage 42 that is provided in a depressed manner in −Z direction with respect to the auxiliary guide surfaces 41, and stores the movable guiding unit 50 in association with an operation to open the covering part 40. In addition, the covering part 40 includes bearing projections 43 that rotatably supports the movable guiding unit 50 around a rotational axis in Y direction, and induction projections 44 that induce rotation of the movable guiding unit 50.

In addition, the covering part 40 includes a depressed section 46 which is provided in a depressed manner in −Z direction with respect to each of the auxiliary guide surfaces 41, and into which a user inserts the hand when paper P fallen on the covering part 40 is removed; and a handle 47 that is operated by a user when the covering part 40 is opened. Furthermore, the covering part 40 includes a pressing member 49 that is provided between the induction projections 44 in the storage 42 and presses the movable guiding unit 50 in Z direction. Also, the covering part 40 is rotatably supported with respect to the housing 30 around a rotational axis in X direction at the end on the upstream side in Y direction via a supporter 45, as an example of another rotational shaft, that extends in X direction.

The auxiliary guide surface 41 is configurated by a plane along XY plane. Also, the auxiliary guide surface 41 is provided adjacent to the upstream side in X direction, the upstream side in Y direction, and the downstream side in Y direction with respect to the storage 42. In other words, in a state where the movable guiding unit 50 is mounted on the covering part 40, the auxiliary guide surface 41 is provided adjacent to the upstream side in X direction, and the upstream side and the downstream side in Y direction with respect to the movable guiding unit 50. When transport of paper P is guided by the movable guiding unit 50 and the fixed guiding unit 60, the auxiliary guide surface 41 guides paper P which has moves out from the movable guiding unit 50 in an auxiliary manner.

The auxiliary guide surface 41 has multiple slits 411, each of which extends in X direction, and is depressed in −Z direction with respect to the surface of the auxiliary guiding surface 41. Also, each of the slits 411 has multiple holes which penetrate through the bottom of the slit 411 in Z direction. Air is blown to the auxiliary guiding surface 41 by a blowing unit (not illustrated) through the holes.

The storage 42 includes an opposed surface 421 including a plane that is opposed to the later-described guiding surface 51 of the movable guiding unit 50 from the upstream side in Z direction. Also, the storage 42 includes side storages 422 that are adjacent to the upstream side and the downstream side of the opposed surface 421 in Y direction, and store the later-described sides 54 of the movable guiding unit 50; a curved storage 423 that is adjacent to the downstream side of the opposed surface 421 in X direction, and stores the later-described curved section 53 of the movable guiding unit 50; and a rotational shaft storage 424 which is adjacent to the upstream side of the opposed surface 421 in X direction, and by which the end on the upstream side of the movable guiding unit 50 in X direction, and the later-described rotational shafts 56 are supported.

The opposed surface 421 has multiple holes 421*a*, each of which penetrates through the opposed surface 421 in Z direction and extends in X direction. Air is blown to the movable guiding unit 50 by a blowing unit (not illustrated) through the holes 421*a*.

The bearing projections 43 are each provided to project in Y direction or in −Y direction toward the opposed bearing projection 43 in the rotational shaft storage 424. Also, the bearing projections 43 are fitted into the later-described rotational shafts 56 of the movable guiding unit 50, and rotatably support the movable guiding unit 50 around a rotational axis in Y direction.

The induction projections 44 are each provided to project in Y direction or in −Y direction toward the opposed induction projection 44 at an area on the downstream side from the center of the side storages 422 in X direction. Also, the induction projections 44 are inserted in the later-described respective notch sections 55 of the movable guiding unit 50, and induce the rotation of the movable guiding unit 50.

The depressed section 46 is provided on the downstream side (the front side of the image forming system 1 (see FIG. 1)) of the covering part 40 in Y direction. Also, the depressed section 46 is provided on the upstream side of the covering part 40 in X direction, and on the upstream side in X direction of the later-described contact position 52*a* of the movable guiding unit 50 mounted on the covering part 40. In the image forming system 1 in the exemplary embodiment, when paper P discharged through the first discharge outlet 31 falls on the covering part 40 before the transport direction is reversed by the reverse transport roller 74, paper P is easily removed from the covering part 40 by inserting the hand of a user into the depressed section 46.

The handle 47 is provided to project to the downstream side (the front side of the image forming system 1) of the covering part 40 in Y direction. In the image forming system 1 in the exemplary embodiment, for instance when the covering part 40 is opened or closed relative to the housing 30, a user holds the handle 47 to operate the covering part 40.

The pressing member 49 is composed of, for instance, an elastic member expandable and contractible in Z direction, more specifically, is composed of a compression coil spring expandable and contractible in Z direction. The pressing member 49 is disposed on the downstream side of the opposed surface 421 of the storage 42 in X direction, and at the central portion of the opposed surface 421 in Y direction. The pressing member 49 has one end (the end of the upstream side in Z direction) fixed to the opposed surface 421 and the other end (the end of the downstream side in Z direction) in contact with the later-described guiding surfaces 51 (and inclined sections 52, see FIG. 6) of the movable guiding unit 50. The pressing member 49 presses the covering part 40 toward the downstream side of the movable guiding unit 50 in Z direction. Consequently, in a state where the covering part 40 is closed relative to the housing 30, the movable guiding unit 50 projects in Z direction from the auxiliary guiding surface 41 of the covering part 40.

Returning to FIG. 4, in a state where the covering part 40 is closed relative to the housing 30, the covering part 40 is opposed to the seventh paper transport route R7 of the paper transporter 70. Also, the covering part 40 supports the driven rollers 81*b* of the fourth transport roller 81 in the paper transporter 70. More particularly, when the movable guiding unit 50 is stored in the storage 42, the covering part 40 supports the driven rollers 81*b* at a position which causes no interference with the movable guiding unit 50. In this example, the covering part 40 supports the driven rollers 81*b* at the opposed surface 421 in the storage 42 and the lower portion (the upstream side in Z direction) of the auxiliary guiding surface 41. Although details will be described later, when the covering part 40 is opened relative to the housing 30, the driven rollers 81*b* of the fourth transport roller 81 are moved along with the covering part 40, and separated from the driving rollers 81*a*. Consequently, the seventh paper transport route R7 of the paper transporter 70 is open to the outside of the image forming apparatus 2.

<Description of Movable Guider>

Figure 6:
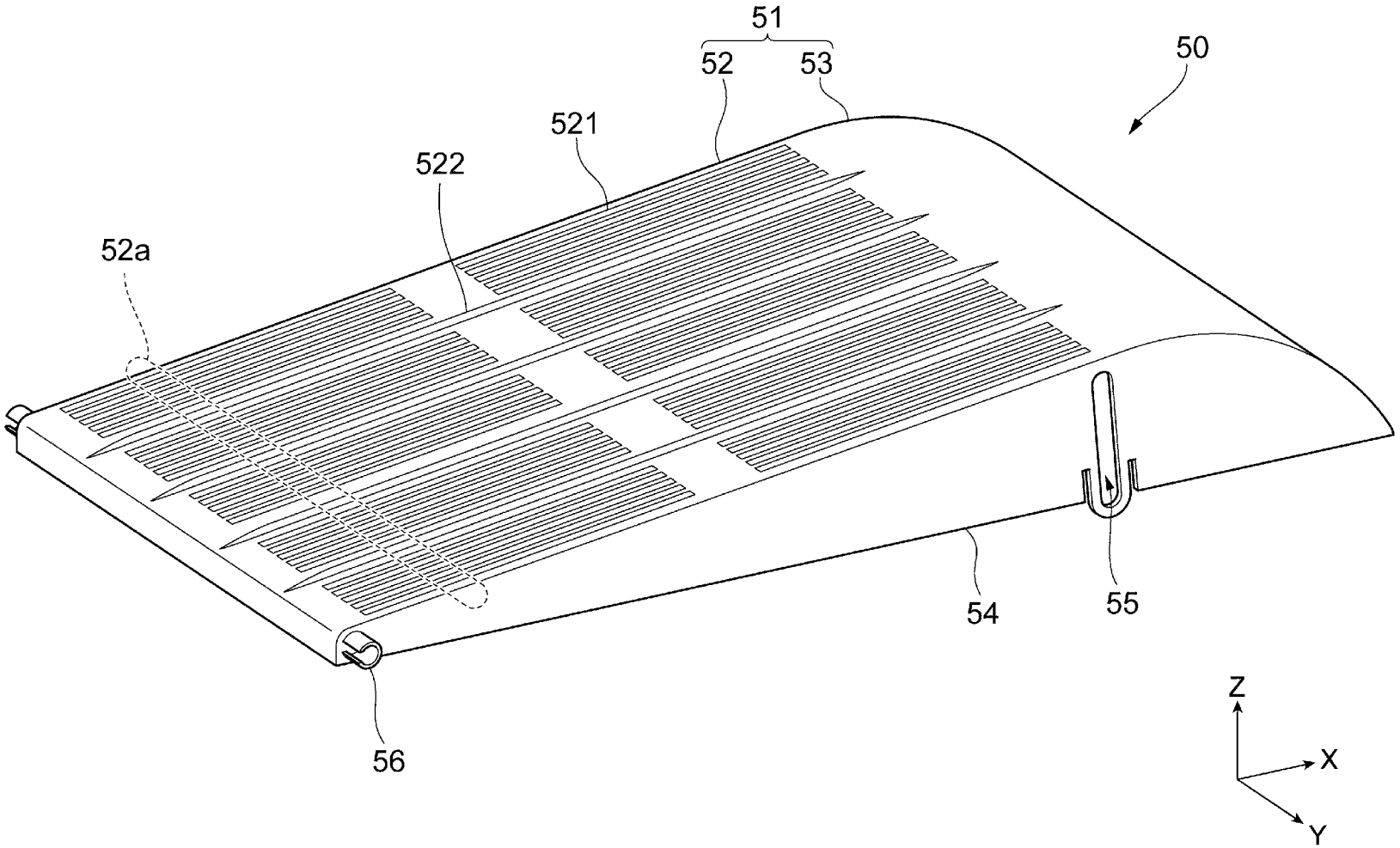
FIG. 6 is a perspective view illustrating a movable guiding unit according to the exemplary embodiment.

Next, the movable guiding unit 50 will be described in detail. FIG. 6 is a perspective view illustrating the movable guiding unit 50 according to the exemplary embodiment. It is to be noted that FIG. 6 illustrates the movable guiding unit 50 in a state (that is, the state illustrated in FIG. 3) the movable guiding unit 50 is not stored relative to the covering part 40. As described above, the movable guiding unit 50 is provided on the downstream side of the covering part 40 in the opening direction (Z direction) in a movable manner with respect to the covering part 40 in association with an operation to open the covering part 40.

The movable guiding unit 50 includes a guiding surface 51 that guides transport of paper P by coming into contact with the lower facing surface (hereinafter referred to as one surface) of paper P discharged through the first discharge outlet 31. In addition, the movable guiding unit 50 includes a pair of sides 54 that extend downward (−Z direction) from both ends of the guiding surface 51 in Y direction. Furthermore, the movable guiding unit 50 includes notch sections 55 which are formed by notching respective sides 54 in Z direction, and in which the induction projections 44 (see FIG. 5) of the covering part 40 are inserted. Furthermore, the movable guiding unit 50 includes rotational shafts 56 which are each provided at the end of the upstream side of the movable guiding unit 50 in X direction, and are fitted into the respective baring projections 43 (see FIG. 5) of the covering part 40.

The guiding surface 51 includes inclined sections 52 each formed of a plane that is inclined to the downstream side in Z direction as moved to the downstream side in X direction; and a curved section 53 which is connected to the end on the downstream side of each inclined section 52 in X direction, is formed of a curved surface that is curved to the upstream side in Z direction as moved to the downstream side in X direction.

The inclined sections 52 have multiple slits 521, each of which extends in X direction, and is depressed in −Z direction with respect to the surface of the inclined sections 52. In this example, the multiple slits 521 are provided such that 25 slits are arranged at intervals in Y direction, and two rows of slits are formed at an interval in X direction on the inclined sections 52. Also, each of the slits 521 has multiple holes which penetrate through the bottom of the slit 521 in Z direction. Air is blown to the inclined sections 52 by a blowing unit (not illustrated) through the holes. In the exemplary embodiment, each inclined section 52 has the multiple slits 521, thus the contact area between the inclined section 52 and paper P is reduced. In particular, when air is blown through the holes, the possibility of contact between the inclined section 52 and paper P is further reduced. Consequently, for instance when dew condensation occurs in the inclined section 52, water drops are not likely to adhere to paper P.

Also, the inclined sections 52 have multiple (five in this example) projection sections 522 which extend continuously from one end to the other end in X direction, and project in Z direction from the surface of the inclined sections 52. In this example, each of the projection sections 522 is formed between adjacent slits 521 formed on the inclined sections 52. In the exemplary embodiment, each inclined section 52 has the projection sections 522, thus paper P is moved on the projection sections 522 on the inclined section 52. As an additional remark, paper P is moved in a state floated from the slits 521 in Z direction due to the projection sections 522. Consequently, ends of paper P are prevented from entering the slits 521, and the possibility of occurrence of transport failure of paper P is reduced. For instance, when static electricity occurs in the inclined section 52, the possibility of occurrence of transport failure of paper P due to adhering of paper P to the inclined section 52 is reduced.

It is to be noted that on the guiding surface 51 in the exemplary embodiment, a slit or a projection is not formed in the curved section 53. As described later, paper P guided by the inclined sections 52 of the guiding surface 51 subsequently comes into contact with and is guided by the fixed guiding unit 60 mainly. Thus paper P is unlikely to come in contact with the curved section 53. Thus, even when neither a slit nor a projection is formed in the curved section 53, a problem due to dew condensation or static electricity mentioned above is not likely to occur.

The sides 54 are each formed of a plane that extends in −Z direction from each of the ends of the upstream side and the downstream side of the guiding surface 51 in Y direction. It is to be noted that FIG. 6 illustrates only one side 54 extending from the end of the downstream side of the guiding surface 51 in Y direction. The sides 54 are each formed of a plane along ZX plane, and are opposed to each other in Y direction with the guiding surface 51 interposed between the sides 54.

The notch sections 55 are formed on the respective sides 54 in Z direction. More specifically, the notch sections 55 are formed to extend in −Z direction on the respective sides 54 from positions adjacent to the end on the downstream side of the inclined section 52 in X direction. Also, the width of each notch section 55 is slightly larger than the diameter of each induction projections 44 of the covering part 40. Consequently, the induction projections 44 of the notch sections 55 are moved smoothly.

The rotational shafts 56 are each provided to project in Y direction or in −Y direction at the end on the upstream side of each side 54 in X direction. The shape of each rotational shaft 56 as viewed in Y direction is a circular shape in which an opening for inserting a corresponding bearing projection 43 of the covering part 40 is formed. It is to be noted that the diameter of the opening of each rotation shaft 56 is slightly larger than the diameter of each bearing projection 43.

When the movable guiding unit 50 is mounted on the covering part 40, for each rotation shaft 56, a corresponding bearing projection 43 of the covering part 40 is inserted. Consequently, the movable guiding unit 50 is supported rotatably with respect to the covering part 40 on the fulcrum point that is a rotational axis connecting two rotation shafts 56 and extending in Y direction. In the exemplary embodiment, the movable guiding unit 50 is rotated with respect to the covering part 40 on a fulcrum point that is a rotational axis extending in Y direction, and thus movement of the movable guiding unit 50 with respect to the covering part 40 is uniform over the length from one end to the other end in Y direction. Therefore, the transport state of the movable guiding unit 50 is not likely to be different between one end and the other end in the width direction (Y direction) of paper P, thus, the possibility of transport failure of paper P is reduced.

<Description of Fixed Guider>

Next, the configuration of the fixed guiding unit 60 will be described with reference to FIGS. 3 and 4. The fixed guiding unit 60 is fixed to the housing 30 so as to be opposed to the curved section 53 in the guiding surface 51 of the movable guiding unit 50 with an interstice. As illustrated in FIG. 3, the width of the fixed guiding unit 60 in Y direction is smaller than the width of the movable guiding unit 50 in Y direction. The fixed guiding unit 60 is opposed to the central portion of the movable guiding unit 50 in Y direction. In the exemplary embodiment, since the width of the fixed guiding unit 60 in Y direction is smaller than the width of the movable guiding unit 50 in Y direction, when the covering part 40 is opened, the movable guiding unit 50 and the fixed guiding unit 60 are unlikely to interfere with each other.

The area of the fixed guiding unit 60 which is opposed to the movable guiding unit 50 is a curved shape according to the shape of the curved section 53 in the guiding surface 51 of the movable guiding unit 50. In the exemplary embodiment, since the fixed guiding unit 60 has a curved shape according to the curved section 53, when the covering part 40 is opened, the movable guiding unit 50 and the fixed guiding unit 60 are unlikely to interfere with each other. In addition, the area of the fixed guiding unit 60 opposed to the movable guiding unit 50 has multiple ribs 61 that extend in X direction and project toward the movable guiding unit 50. Since the fixed guiding unit 60 has the multiple ribs 61, the contact area between the fixed guiding unit 60 and paper P when paper P is guided by the fixed guiding unit 60 is reduced. Thus, for instance when dew condensation or static electricity occurs in the fixed guiding unit 60, the possibility of occurrence of transport failure of paper P is reduced.

<Description of Guidance of Paper in Paper Guider>

In the image forming system 1 (see FIG. 1) in the exemplary embodiment, when double-sided printing is performed in the image forming apparatus 2, the reverse transport roller 74 that reverses the transport direction of paper P is disposed adjacent to the first discharge outlet 31. Thus, when the transport direction of paper P is reversed by the reverse transport roller 74, the length of one end of paper P discharged to the outside through the first discharge outlet 31 is likely to be long, as compared with the case where the reverse transport roller 74 is at a position apart from the first discharge outlet 31. Particularly, when the length of paper P discharged exceeds the width of the image forming apparatus 2, in X direction, the front end of discharged paper P may interfere with part of the housing 30 of the image forming apparatus 2 or the post-processing apparatus 3 adjacent to the image forming apparatus 2, and transport failure of paper P may occur.

In contrast, in the exemplary embodiment, transport of paper P discharged through the first discharge outlet 31 is guided by the paper guiding unit 90, thus interference of the front end of paper P with part of the housing 30 or the post-processing apparatus 3 is reduced. Next, the guidance of paper P discharged through the first discharge outlet 31 in the paper guiding unit 90 will be described with reference to FIG. 4.

First, due to rotation of the reverse transport roller 74 in the forward direction, one end of paper P discharged to the paper guiding unit 90 through the first discharge outlet 31 comes into contact with the guiding surface 51 of the movable guiding unit 50. More specifically, one end of paper P discharged through the first discharge outlet 31 comes into contact with the inclined section 52 of the guiding surface 51. In the description below, let a contact position 52*a* be the position of the inclined section 52, with which one end of paper P discharged through the first discharge outlet 31 comes into contact for the first time. The movable guiding unit 50 in the exemplary embodiment is designed so that the rotation shaft 56 which serves as a rotational shaft of the movable guiding unit 50 is located on the upstream side in X direction with respect to the contact position 52*a* in the inclined section 52. Consequently, one end of paper P is prevented from entering an interstice between the guiding surface 51 of the movable guiding unit 50 and the auxiliary guiding surface 41 of the covering part 40, thus the possibility of transport failure of paper P is reduced.

Subsequently, the rotation of the reverse transport roller 74 in the forward direction causes paper P to be further discharged to the paper guiding unit 90 through the first discharge outlet 31, and paper P is transported to the downstream side in X direction with one surface of paper P in contact with the inclined section 52.

When one end of paper P arrives at the end on the downstream side of the inclined section 52 in X direction, as illustrated with a dashed line in FIG. 4, the one end of paper P moves away from the guiding surface 51 due to the elasticity of paper P itself, and comes into contact with the fixed guiding unit 60. The transport direction of paper P is changed to downward (−Z direction) by the fixed guiding unit 60, and paper P is transported between the fixed guiding unit 60 and the curved section 53 of the guiding surface 51.

Subsequently, the rotation direction of the reverse transport roller 74 is switched to the reverse direction, and the transport direction of paper P is reversed. Consequently, paper P discharged to the paper guiding unit 90 is passed through the guiding surface 51 of the movable guiding unit 50, and is drawn in the image forming apparatus 2 through the first discharge outlet 31. Consequently, guidance of paper P, which has been discharged through the first discharge outlet 31, by the paper guiding unit 90 is completed.

Here, as described above, the inclined section 52 in the guiding surface 51 of the movable guiding unit 50 has a shape which is inclined to the downstream side in Z direction as the position moves to the downstream side in X direction. Also, the curved section 53 in the guiding surface 51 and the fixed guiding unit 60 have a curved shape that moves to the upstream side in Z direction as a position moves to the downstream side in Z direction. Thus, in the paper guiding unit 90, the transport route along which paper P is transported is longer, as compared with the case where paper P is transported horizontally in X direction. As an additional remark, in the paper guiding unit 90, the length of a transport route is increased, along which paper P discharged through the first discharge outlet 31 arrives at part of the housing 30 located on the downstream side in X direction in the image forming apparatus 2 or the post-processing apparatus 3 (see FIG. 1).

As a result, in the image forming system 1 in the exemplary embodiment, paper P discharged by the reverse transport roller 74 is guided by the paper guiding unit 90, thereby reducing interference of one end of paper P with part of the housing 30 of the image forming apparatus 2 or the post-processing apparatus 3. Accordingly, the possibility of transport failure of paper P is reduced.

It is to be noted that in the movable guiding unit 50 in the exemplary embodiment, the guiding surface 51, which guides the surface of paper P discharged through the first discharge outlet 31, has the inclined section 52 and the curved section 53. However, the shape of the guiding surface 51 is not particularly limited, as long as the transport route along which paper P is transported is increased, as compared with the case where paper P is transported horizontally in X direction. In other words, it is sufficient that at least a partial area of the guiding surface 51 of the movable guiding unit 50 be inclined with respect to a horizontal direction. For instance, the guiding surface 51 may be a corrugated surface including continued two planes: one is inclined to the downstream side in Z direction as the position is closer to the downstream side in X direction, and the other is inclined to the upstream side in Z direction as the position is closer to the downstream side in X direction.

<Description of Movable Guiding Unit in Association with Operation to Open Covering Part>

In the image forming system 1, for instance, when paper P jamming occurs in the seventh paper transport route R7, to remove paper, the covering part 40 may be opened to leave the seventh paper transport route R7 open. As described above, the movable guiding unit 50 is provided adjacent to the downstream side in the opening direction (Z direction) to open the covering part 40 with respect to the covering part 40. In the paper guiding unit 90 of the exemplary embodiment, in association with an operation to open the covering part 40, the movable guiding unit 50 relatively moves to the covering part 40 so that interference of the movable guiding unit 50 with the operation to open the covering part 40 is prevented.

Figure 7:
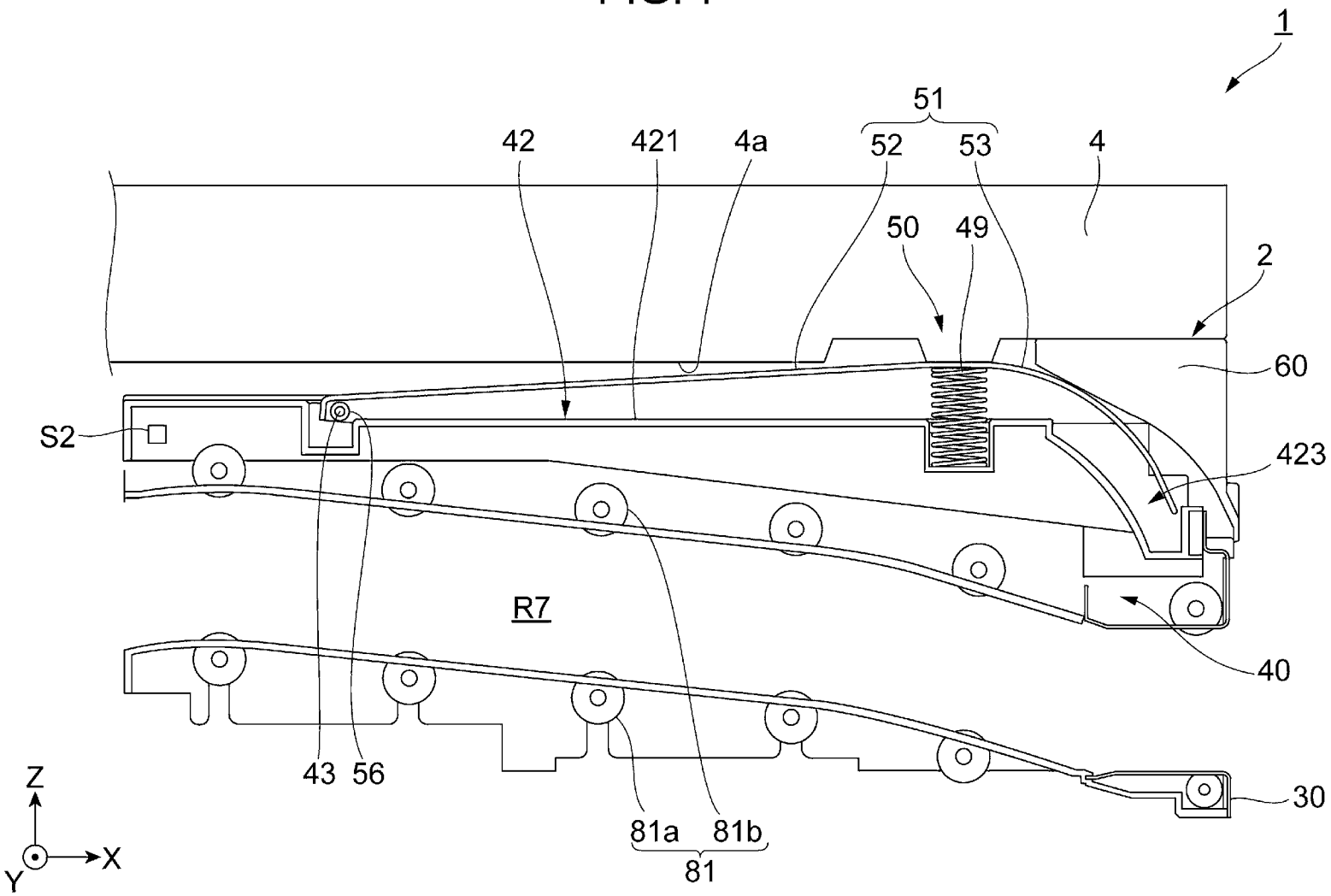
FIG. 7 is a sectional view, taken along ZX plane, of the paper guiding unit with the covering part open.
Figure 8:
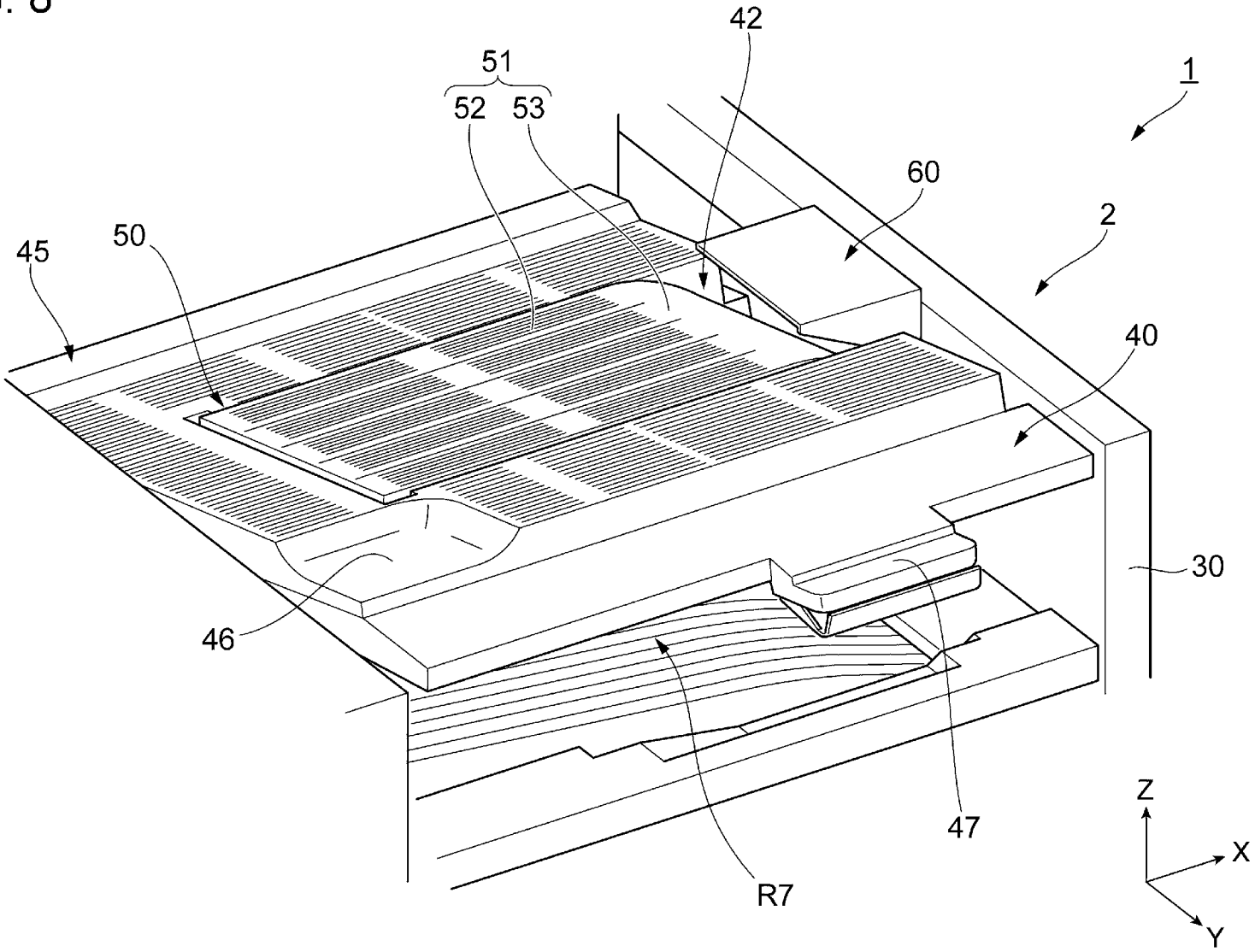
FIG. 8 is a perspective view of the paper guiding unit with the covering part open as viewed down from the front side of the image forming apparatus.

FIG. 7 is a sectional view, taken along ZX plane, of the paper guiding unit 90 with the covering part 40 open. FIG. 8 is a perspective view of the paper guiding unit 90 with the covering part 40 open as viewed down from the front side of the image forming apparatus 2. It is to be noted that in FIG. 8, the image reading apparatus 4 (see FIG. 1) is not illustrated. Hereinafter the movement of the movable guiding unit 50 in association with an operation to open the covering part 40 will be described in detail with reference to FIGS. 7 and 8 and above-mentioned FIGS. 3 and 4.

As described above, in a state where the covering part 40 is closed relative to the housing 30, the covering part 40 is pressed by the pressing member 49 in Z direction, and the movable guiding unit 50 projects in Z direction with respect to the auxiliary guiding surface 41 of the covering part 40.

First, when the handle 47 is folded by a user and the covering part 40 is opened, the front side (the downstream side in Y direction) in the covering part 40 is raised. In the rear side (the upstream side in Y direction), the covering part 40 is rotated around a rotational axis of the supporter 45 extending in X direction. The end on the front side in the covering part 40 is moved in Z direction as indicated by arrow Q1 in FIG. 4.

Also, the covering part 40 is raised in Z direction, and accordingly, the movable guiding unit 50 mounted on the covering part 40 is similarly moved in Z direction. As described above, the movable guiding unit 50 projects in Z direction with respect to the covering part 40. In the image forming system 1 in the exemplary embodiment, the image reading apparatus 4 is disposed above the image forming apparatus 2 (the downstream side in Z direction). For this reason, when the covering part 40 is raised in Z direction, the movable guiding unit 50 bumps into the lower surface 4*a* of the image reading apparatus 4. In this example, the downstream side of the covering part 40 in Y direction is raised upward, thus in the movable guiding unit 50, the end on the downstream side of the guiding surface 51 in Y direction bumps into the lower surface 4*a* of the image reading apparatus 4.

Subsequently, when the covering part 40 is further raised in Z direction, the movable guiding unit 50 is pressed by the lower surface 4*a* of the image reading apparatus 4, thus the covering part 40 which moves in Z direction to the downstream side, whereas the movable guiding unit 50 relatively moves to the upstream side in Z direction. Specifically, as indicated by arrow Q2 in FIG. 4, the movable guiding unit 50 is rotated clockwise in FIG. 4 on the fulcrum point that is a rotational axis connecting two rotation shafts 56 and extending in Y direction. Thus, the movable guiding unit 50 relatively moves to the upstream side of the covering part 40 in Z direction against the pressing force by the pressing member 49. In this process, the induction projections 44 of the covering part 40 move along the notch sections 55 of the movable guiding unit 50, relative movement of the movable guiding unit 50 with respect to the covering part 40 is smoothly performed. As illustrated in FIGS. 7 and 8, the movable guiding unit 50 is stored in the storage 42 of the covering part 40.

In this manner, the movable guiding unit 50 relatively moved to the upstream side in Z direction with respect to the covering part 40, and the covering part 40 can be opened in Z direction without interfering with the movable guiding unit 50. The seventh paper transport route R7 is left open by opening the covering part 40 in Z direction. More specifically, the driven roller 81*b* provided in the seventh paper transport route R7 is moved in Z direction along with the covering part 40, and is separated from the driving roller 81*a*. Thus, the seventh paper transport route R7 of the paper transporter 70 is left open outside the image forming apparatus 2. As a result, a user can insert the hand from the front side of the image forming system 1, and jamming of paper P in the seventh paper transport R7 can be fixed.

Here, as described above, in the exemplary embodiment, the driven roller 81*b* provided in the seventh paper transport route R7 is supported at a position not interfering with the movable guiding unit 50 stored in the covering part 40. Thus, interference of movement of the movable guiding unit 50 and an operation to open the covering part 40 with the driven roller 81*b* is reduced.

As described above, similarly to the movable guiding unit 50, the fixed guiding unit 60 is provided on the downstream side in the opening direction (Z direction) to open the covering part 40, whereas unlike the movable guiding unit 50, the fixed guiding unit 60 is fixed to the housing 30. As described below, the operation to open the covering part 40 is not likely to be interfered with the fixed guiding unit 60. Specifically, as described above, the lengths of the fixed guiding unit 60 in Y direction and X direction are shorter than those of the movable guiding unit 50. Also, the fixed guiding unit 60 has a shape according to the curved section 53 in the guiding surface 51 of the movable guiding unit 50, and is disposed to be opposed to the curved section 53. Thus, as illustrated in FIG. 7, when the covering part 40 is opened, and the movable guiding unit 50 is stored in the covering part 40, the fixed guiding unit 60 is stored in the space formed between the curved section 53 of the movable guiding unit 50 stored in the covering part 40, and the lower surface 4*a* of the image reading apparatus 4. Thus, the fixed guiding unit 60 does not interfere with the movable guiding unit 50 and the covering part 40. Thus, interference of the fixed guiding unit 60 with the operation to open the covering part 40 is reduced.

In the exemplary embodiment, the movable guiding unit 50 is rotated around a rotational axis extending in Y direction, and thus in association with an operation to open the covering part 40 in Z direction, the movable guiding unit 50 relatively moves to the upstream side in Z direction with respect to the covering part 40. However, the movable guiding unit 50 is not limited to the above-mentioned configuration as long as in association with an operation to open the covering part 40 in Z direction, the movable guiding unit 50 moves relatively to the covering part 40 to the upstream side in Z direction. For instance, in association with an operation to open the covering part 40 in Z direction, the entire movable guiding unit 50 may move linearly for the covering part 40 in Z direction.

In the exemplary embodiment, when the covering part 40 is opened, the movable guiding unit 50 comes into contact with and pressed by the lower surface 4*a* of the image reading apparatus 4, thereby moving relatively to the covering part 40. However, the configuration of the movable guiding unit 50 is not limited to this as long as the movable guiding unit 50 moves relatively to the covering part 40 in conjunction with an operation to open the covering part 40.

Furthermore, in the exemplary embodiment, when the covering part 40 is opened, the movable guiding unit 50 is stored in the covering part 40. However, the covering part 40 and the movable guiding unit 50 are not limited to this configuration, as long as the movable guiding unit 50 moves to the upstream side relatively to the covering part 40 in Z direction. For instance, when the length of the movable guiding unit 50 in Y direction is longer the length of the covering part 40 in Y direction, in association with an operation to open the covering part 40, the movable guiding unit 50 may move relatively to the covering part 40, and the covering part 40 may be stored in the movable guiding unit 50.

In the above, an example has been described in which the image forming system 1 includes the post-processing apparatus 3 and the image reading apparatus 4. However, an apparatus to which the paper guiding unit 90 in the exemplary embodiment is applicable is not particularly limited, and for instance, the paper guiding unit 90 is applicable to the image forming system 1 not including the post-processing apparatus 3 and the image reading apparatus 4.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body including an image former that forms an image on a recording material;

a covering part that is provided in the apparatus body and leaves an inside of the apparatus body open by being opened in an opening direction with respect to the apparatus body;

a reversing unit that is housed by the apparatus body and discharges part of the recording material on which the image is formed by the image former externally of the apparatus body, and reverses a transport direction of the recording material; and a guiding unit that is provided adjacent to a downstream side of the covering part in the opening direction, guides the recording material discharged through the apparatus body by the reversing unit, and when the covering part is opened with respect to the apparatus body, the guiding unit moves relatively with respect to the covering part in an opposite direction of the opening direction.

2. The image forming apparatus according to claim 1, wherein the apparatus body has a transport route along which the recording material on which the image is formed by the image former is transported, and the covering part leaves part of the transport route open by being opened with respect to the apparatus body.

3. The image forming apparatus according to claim 2, wherein the guiding unit guides a widthwise central portion of the recording material discharged through the apparatus body, and when the covering part is opened with respect to the apparatus body, at least part of the guiding unit is stored in the covering part.

4. The image forming apparatus according to claim 3, wherein the covering part includes a transporter that transports the recording material along the transport route, and when the guiding unit is stored in the covering part, the guiding unit does not interfere with the transporter of the covering part.

5. The image forming apparatus according to claim 4, wherein the apparatus body includes the transporter of the covering part and a different transporter that transports the recording material, and the transporter of the covering part transports the recording material by being driven by the different transporter.

6. The image forming apparatus according to claim 1, wherein the guiding unit comprises a guiding surface, at least part of the guiding surface that guides the recording material discharged externally of the apparatus body is inclined with respect to a horizontal direction.

7. The image forming apparatus according to claim 6, wherein the guiding surface includes an inclined section that extends in a movement direction of the recording material discharged externally of the apparatus body, and is inclined in a direction in which the inclined section departs away from the covering part as a position on the inclined section is closer to a downstream side of the inclined section in the movement direction.

8. The image forming apparatus according to claim 1, wherein when the covering part is opened, rotation of the guiding unit around a rotational axis extending in a direction crossing a movement direction of the recording material discharged externally of the apparatus body causes an area on a downstream side of the rotational axis in the movement direction to move in an opposite direction of the opening direction relatively with the covering part.

9. The image forming apparatus according to claim 8, wherein the guiding unit has a guiding surface that guides the recording material discharged externally of the apparatus body, and the rotational axis is disposed on an upstream side in the movement direction from a position at which the recording material discharged externally of the apparatus body first comes into contact with the guiding surface.

10. The image forming apparatus according to claim 1, wherein the guiding unit has a guiding surface that guides the recording material discharged externally of the apparatus body, and the guiding surface includes a plurality of slits that extend in a movement direction of the recording material.

11. The image forming apparatus according to claim 10, wherein the guiding unit includes a projection between the plurality of slits in the guiding surface, the projection projecting from the guiding surface and extending in the movement direction.

12. The image forming apparatus according to claim 1, further comprising a different guiding unit that is fixed to the apparatus body to be opposed to the guiding unit with an interstice at a widthwise central portion of the recording material discharged externally of the apparatus body, the widthwise central portion crossing a movement direction of the recording material, the different guiding unit guiding the recording material along with the guiding unit.

13. The image forming apparatus according to claim 12, wherein the guiding unit has a curved section that is curved in a direction in which the curved section comes closer to the covering part as a position on the curved section is closer to a downstream side of the curved section in the movement direction, and the different guiding unit is provided to be opposed to the curved section, and when the covering part is opened, the different guiding unit does not come into contact with the covering part and the guiding unit.

14. The image forming apparatus according to claim 1, wherein the covering part has a different rotational axis that is fixed to the apparatus body and extends in a movement direction of the recording material discharged externally of the apparatus body, and leaves the inside of the apparatus body open by being rotated upward around the different rotational axis as a center, when the covering part is opened with respect to the apparatus body, the guiding unit moves downward relatively with respect to the covering part.

15. The image forming apparatus according to claim 14, further comprising an image reader that reads an image disposed above the guiding unit and formed on the recording material, wherein when the covering part is opened with respect to the apparatus body, the guiding unit bumps into the image reader, and moves downward relatively with respect to the covering part.

16. A recording material transport device comprising:

an apparatus body;

a transporter housed in the apparatus body and along which a recording material on which an image is formed is transported;

an covering part that is provided in the apparatus body and leaves part of the transporter open by being opened in an opening direction;

a transporter for reversal that branches from the transporter and reverses a transport direction of the recording material;

a discharge outlet for reversal through which part of the recording material, in which the transport direction is reversed by the transporter for reversal, is discharged; and a guiding unit that is provided on a downstream side of the covering part in the opening direction, guides the recording material discharged through the discharge outlet for reversal, and when the covering part is opened, the guiding unit moves relatively with the covering part in an opposite direction of the opening direction.

* * * * *